US008100275B2

(12) United States Patent
Trowsdale et al.

(10) Patent No.: US 8,100,275 B2
(45) Date of Patent: Jan. 24, 2012

(54) CONNECTING MEMBER FOR A CLOTHES AIRER

(75) Inventors: Dan Trowsdale, Leeds (GB); Paul Wigzell, Cornwall (GB); Ryan Hobson, Rochdale (GB)

(73) Assignee: Vale Mill (Rochdale) Limited, Rochdale, Lancashire (GB)

( * ) Notice: Subject to any disclaimer, the term of this patent is extended or adjusted under 35 U.S.C. 154(b) by 402 days.

(21) Appl. No.: 12/352,318

(22) Filed: Jan. 12, 2009

(65) Prior Publication Data

US 2009/0178990 A1 Jul. 16, 2009

(30) Foreign Application Priority Data

Jan. 12, 2008 (GB) ..... 0800535.7

(51) Int. Cl.
*A47B 47/00* (2006.01)

(52) U.S. Cl. ..... 211/195; 211/85.24; 211/200

(58) Field of Classification Search ..... 211/150, 211/195, 85.24, 96, 90.01–90.04, 200, 182, 211/198, 201, 203; 248/164, 431; 403/64, 403/157; 135/135, 147, 120.3
See application file for complete search history.

(56) References Cited

U.S. PATENT DOCUMENTS

| | | | | |
|---|---|---|---|---|
| 909,489 | A * | 1/1909 | Watkins et al. | 108/32 |
| 1,209,679 | A * | 12/1916 | Decker | 5/116 |
| 2,893,767 | A * | 7/1959 | Buchman | 403/64 |
| 3,298,537 | A * | 1/1967 | Di Marco | 211/200 |
| 3,365,209 | A * | 1/1968 | Fischer | 280/20 |
| 4,637,748 | A * | 1/1987 | Beavers | 403/170 |
| 4,705,247 | A * | 11/1987 | Delmerico | 248/98 |
| 5,573,027 | A * | 11/1996 | Hsiung | 135/142 |
| 5,645,259 | A * | 7/1997 | Chen | 248/436 |
| 6,431,193 | B2 * | 8/2002 | Carter | 135/145 |
| 6,877,622 | B2 * | 4/2005 | Tsai | 211/195 |
| 7,168,580 | B2 * | 1/2007 | Larimer et al. | 211/200 |
| 7,172,081 | B2 * | 2/2007 | Trowsdale | 211/202 |
| 7,296,699 | B2 * | 11/2007 | Hung et al. | 211/189 |
| 2004/0051009 | A1 * | 3/2004 | Chen | 248/163.1 |
| 2005/0247655 | A1 * | 11/2005 | Larimer et al. | 211/200 |
| 2006/0138066 | A1 * | 6/2006 | Hung et al. | 211/189 |
| 2007/0023074 | A1 * | 2/2007 | Choi | 135/120.3 |
| 2008/0078433 | A1 * | 4/2008 | Jang | 135/147 |
| 2009/0184073 | A1 * | 7/2009 | Lu | 211/85.3 |

FOREIGN PATENT DOCUMENTS

| | | | |
|---|---|---|---|
| EP | 1001071 | A1 | 5/2000 |
| FR | 2562102 | A1 | 10/1985 |
| FR | 2612957 | A1 | 9/1988 |
| FR | 2763967 | A3 | 12/1998 |
| NL | 7305128 | A | 10/1973 |
| NL | 7507181 | A | 12/1975 |

* cited by examiner

*Primary Examiner* — Jennifer E. Novosad
(74) *Attorney, Agent, or Firm* — Barlow, Josephs & Holmes, Ltd.

(57) ABSTRACT

A connecting member for connecting a plurality of frame elements. The connecting member has a core section having a width and two supporting members for supporting frame elements extending in different directions from the connecting member. The connecting member has at least one additional member for supporting a further frame element. The or each additional supporting member is pivotally connected to the core section and moveable between a first position in which the additional supporting member lies within the width of the core section and a second position in which a frame element supported by the additional support will extend in a direction generally perpendicular to a frame element supported by a supporting element of the core section.

16 Claims, 8 Drawing Sheets

CONNECTING MEMBER FOR A CLOTHES AIRER

BACKGROUND AND SUMMARY OF THE INVENTION

The present invention relates to a connecting member for a clothes airer, in particular, but not exclusively, a tower airer.

Clothes airers come in a variety of shapes and sizes and are primarily focused with providing maximum drying capacity whilst keeping the size of the airer to a minimum. Typically, clothes ariers have a collapsed position whereby they are folded in upon themselves to allow them to be stored away in a space saving fashion, and an expanded position in which they provide a frame work to which garments can be hung for drying purposes.

One such clothes airer is known as a tower airer. Conventional tower airers are typically comprised of four frame elements connected at their respective ends to a connecting member. The connecting member is usually comprised of a central hollow tube for receiving the end of a frame element at either end of the tube, and two additional hollow tubes pivotally mounted on either side of the central tube. The pivotally mounted tubes usually have two extreme positions, one in which the tube is parallel to the central tube and the other in which the tube is perpendicular to the hollow tube. However, the use of such a connecting member gives rise to a tower airer that can only be collapsed to a thickness of three tubes which limits the number of units that can be distributed at any one time and takes up excessive storage space in the home. To maximise the number of units that can be transported and distributed around the globe and to minimise the amount of storage space taken by a tower airer, it is desirable to keep the thickness of the unit in a collapsed state to a minimum.

Embodiments of the present invention have been made in consideration of the abovementioned problems.

According to a first aspect of the present invention, there is provided a connecting member for connecting a plurality of frame elements, the connecting member comprising a core section having a width and two supporting members for supporting frame elements extending in different directions from the connecting member, the connecting member having at least one additional member for supporting a further frame element, the or each additional supporting member being pivotally connected to the core section and moveable between a first position in which the additional supporting member lies within the width of the core section and a second position in which a frame element supported by the additional support will extend in a direction generally perpendicular to a frame element supported by a supporting element of the core section.

Advantageously, a tower airer made with a connecting member according to the present invention can be collapsed to an overall thickness of approximately two frame elements as opposed to the conventional three. Thus, 50% more units than normal can be packed into a given space and transported by, for instance, a lorry for distribution purposes. Furthermore, a home user requires less space to store such a tower airer thus freeing up more space for other items.

Preferably there are two additional supporting members. More preferably, one additional supporting member is pivotally mounted to one side of the core section and the other additional supporting member is pivotally mounted to the opposite side of the core section.

Preferably, the additional members are arranged to support frame elements in substantially parallel spaced apart directions. Preferably, the supporting members of the core section are arranged to support frame elements in substantially parallel, spaced apart directions.

Preferably, the support members comprise fittings arranged to connect to a frame element. More preferably, the support members comprise hollow tubes. The support members may be arranged to support elongate frame elements. Preferably, the hollow tubes have an internal diameter which is substantially equivalent to the external diameter of an elongate frame element that is intended to be supported by the connecting member.

According to a second aspect of the present invention, there is provided a clothes airer comprising a connecting member according to the first aspect of the present invention.

Preferably, there are two connecting members and four frame elements respectively connected to a supporting member of each connecting member. Preferably, two frame elements are fixed to a corresponding supporting member of each connecting member and two frame elements are releasably attached to a corresponding supporting member of each connecting member. More preferably, two frame elements are fixed to supporting members at the same end of each connecting member and the other two frame elements are releasably attached to supporting members at the opposite end of each connecting member.

At least one support is preferably attached to the two frame elements that are supported by a supporting member of the core section at the same corresponding point along each frame element. The clothes airer preferably comprises at least one shelf. Preferably the shelf is rectangular and pivotally mounted at two adjacent corners to a pair of supports. At least one retention clip is preferably attached to the two frame elements that are supported by the pivotally mounted supporting members at the same corresponding points along each frame element as the supports. The retention clip preferably has a recess that is sized and configured to receive a longitudinal edge of a shelf.

BRIEF DESCRIPTION OF THE DRAWING FIGURES

In order that the invention may be more clearly understood embodiments thereof will now be described, by way of example, with reference to the accompanying drawings in which.

DETAILED DESCRIPTION OF THE PREFERRED EMBODIMENTS

Figure 1:
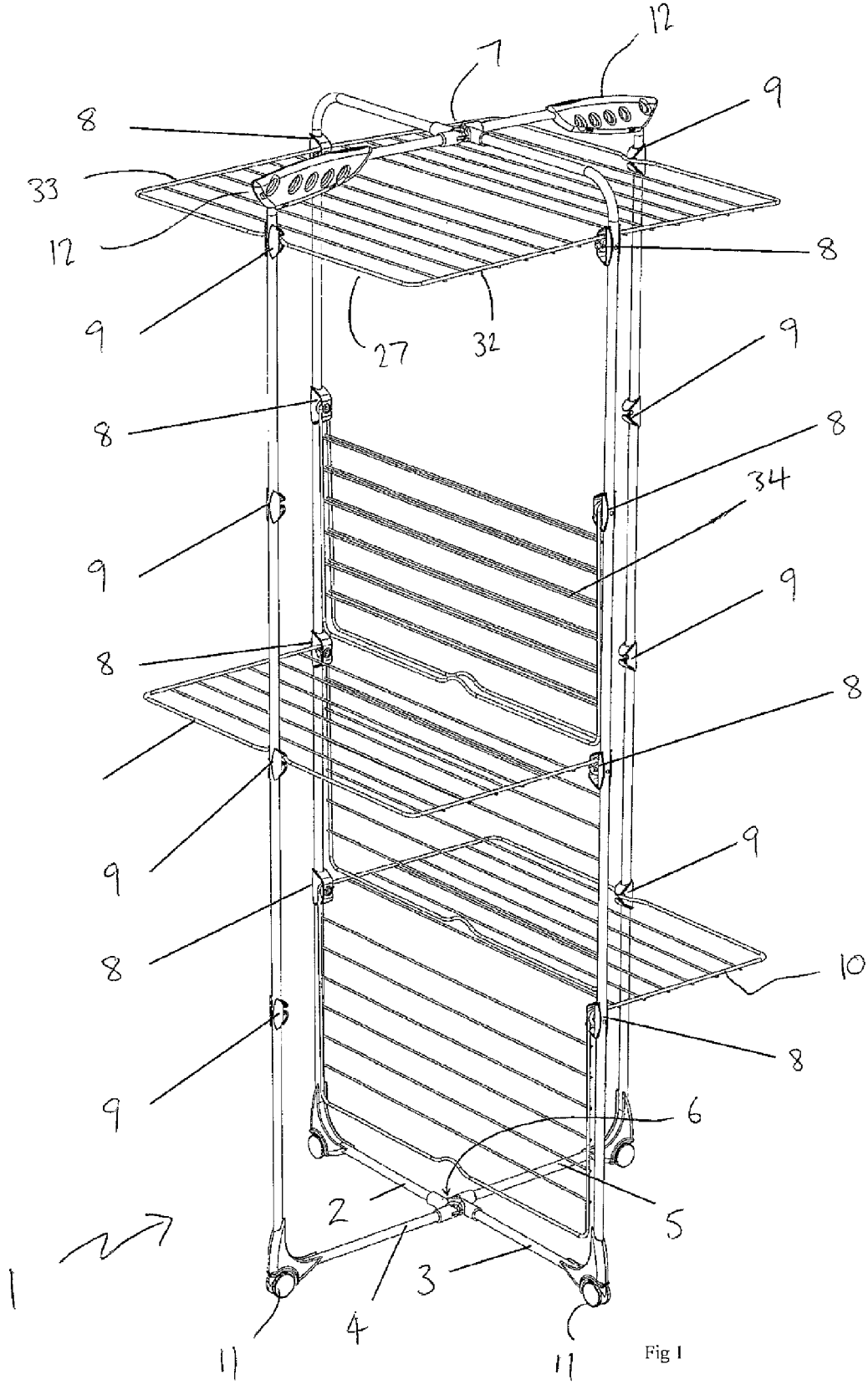
FIG. 1 is a perspective view of a clothes airer comprising a connecting member according to the invention.

Referring to FIG. 1 there is shown a free standing clothes airer 1 comprising four frame elements 2, 3, 4 and 5 each connected at both ends to a respective moulded plastic connecting member 6, 7. Two of the frame elements 2, 3 are fixed to the connecting members 6, 7 whilst the other two frame elements 4, 5 are releasably connected to the connecting members 6, 7.

Attached at spaced apart intervals along the upright length of each fixed frame element 2, 3 are four moulded plastic supports 8 which act as means for supporting one or more shelves 10. Attached at the same corresponding points along the upright length of each releasable frame element 4, 5 are four moulded plastic retention means 9 in the form of clips which serve to receive an edge of a shelf. Two rectangular shelves 10 are independently pivotally connected at two adjacent corners to a pair of opposed supports 8.

A moulded plastic wheel 11 is pivotally connected to the lower corner of each frame element 2, 3, 4 and 5 via a moulded plastic clip which is secured to the frame of the clothes airer. The wheels 11 enable the entire upright clothes airer to be easily manoeuvred when in the expanded state as shown in FIG. 1. A moulded plastic hanger support 12 is attached to the upper corner of each releasable frame element 4, 5.

Each frame element 2, 3, 4, 5 is formed from two L-shaped portions connected together at the end of their respective longest lengths to form a C-shape. Each L-shaped portion is comprised of an elongate hollow tubular member, typically made from mild steel, which has been bent at a point along its length in such a way as to give a curved corner. The two lengths of each L-shaped portion are therefore substantially perpendicular to one another.

Figure 2:
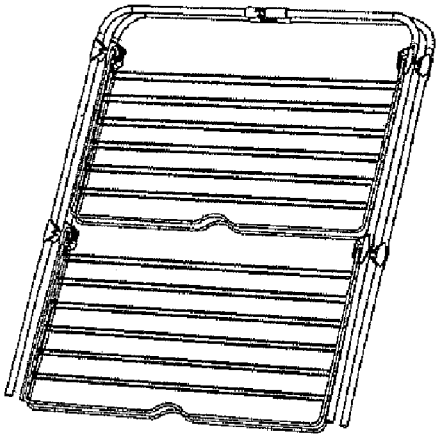
FIG. 2 is a perspective view of part of the clothes airer shown in FIG. 1 when in a collapsed and dismantled state.
Figure 3:
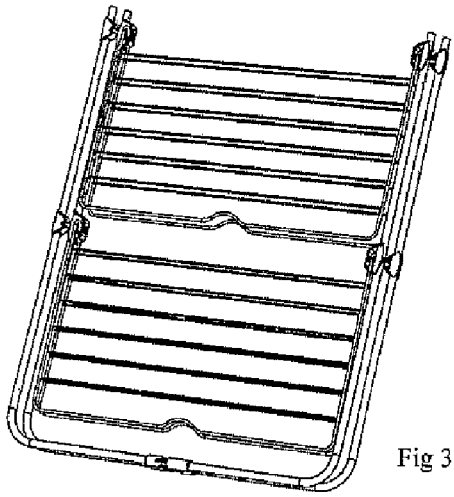
FIG. 3 is a perspective view of the other part of the clothes airer shown in FIG. 1.

The external diameter of one end of an L-shaped member is substantially equivalent to the internal diameter of the other L-shaped member to which it is intended to be connected so that one end can be inserted into the end of the other to provide an interference fit. Alternatively, the two L-shaped elements share the same approximate internal and external diameters and are connected together by a common inner tube or fitting that engages with each element and holds them together. The two elements could alternatively be held together by a latch means. As shown in FIGS. 2 and 3, this permits the clothes airer 1 to be broken down into two halves for more compact storage.

Figure 10:
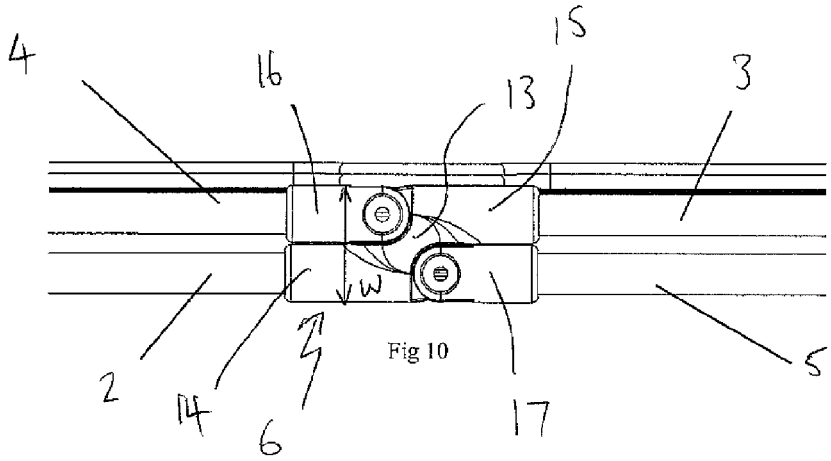
FIG. 10 is a plan view of part of the clothes airer shown in FIG. 1 showing the connecting member according to the present invention in a collapsed state.
Figure 11:
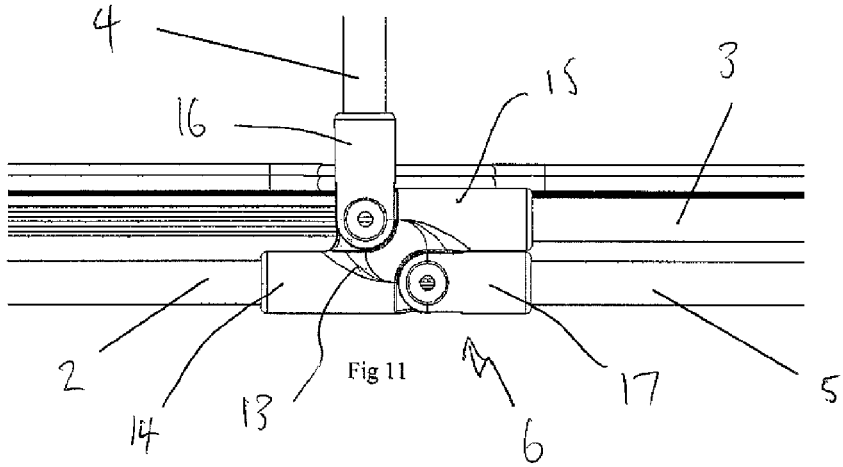
FIG. 11 is a plan view of part of the clothes airer shown in FIG. 1 showing the connecting member according to the present invention in a partially expanded state.
Figure 12:
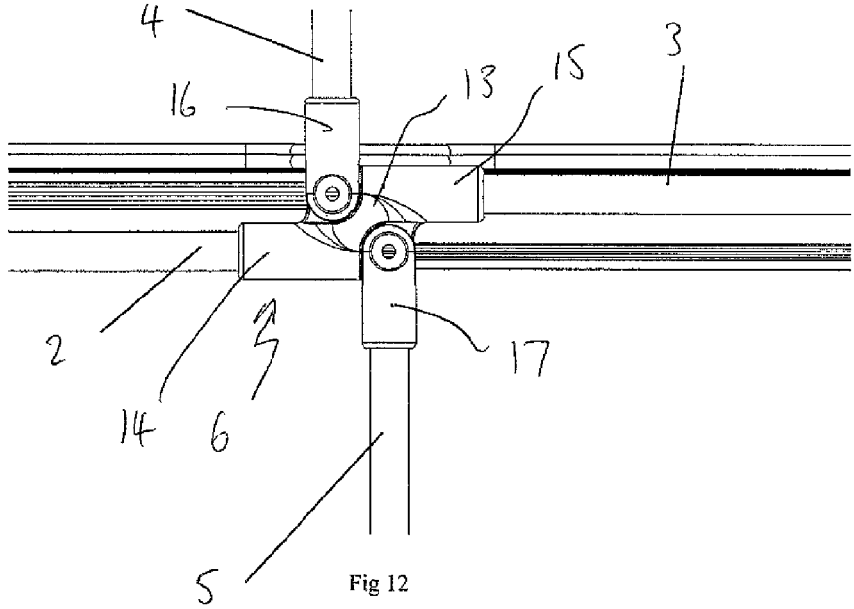
FIG. 12 is a plan view of part of the clothes airer shown in FIG. 1 showing the connecting member according to the present invention in a fully expanded state.
Figure 13:
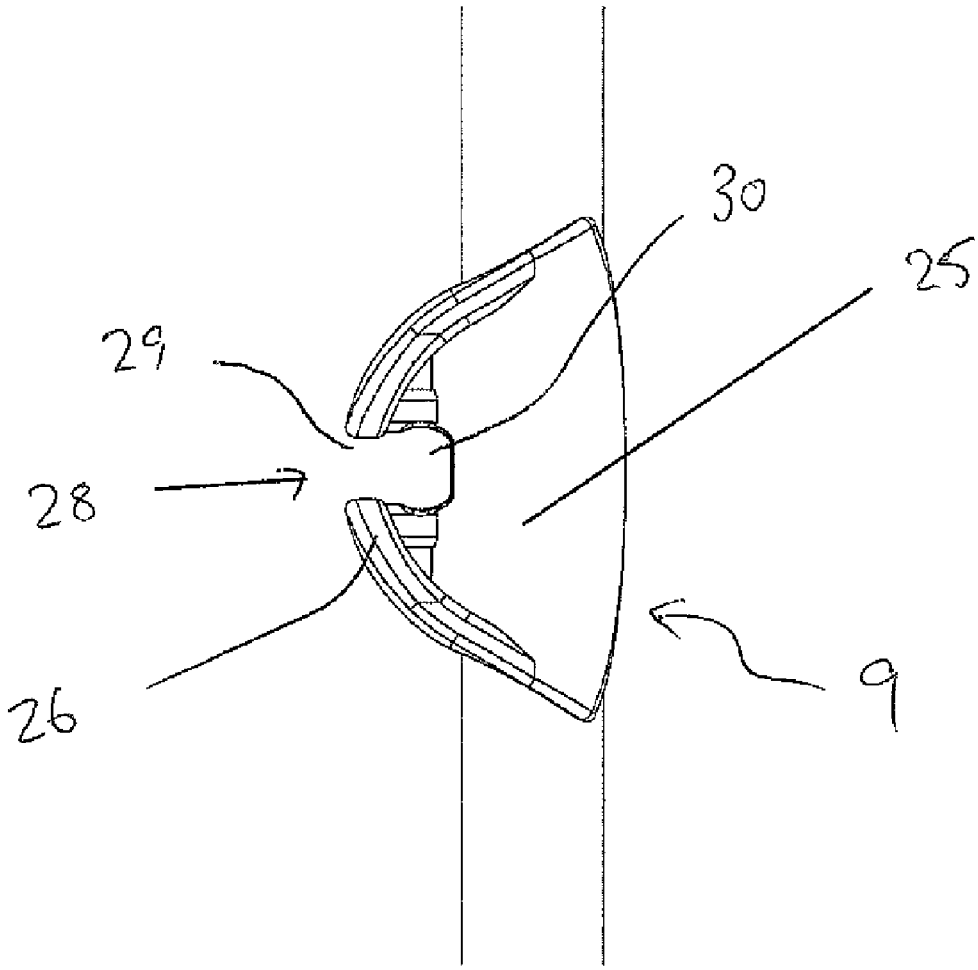
FIG. 13 is a side view of a shelf retention means fixed to the frame of the clothes airer shown in FIG. 1.

Referring to FIGS. 10, 11 and 12, the connecting member 6 comprises a central core section 13 having two supporting members formed from hollow tubes 14, 15 each of which are open at one end for receiving an end of a C-shaped frame element 2, 3, 4 and 5. The internal diameter of the two tubes 14, 15 is approximately equal to the external diameter of the elongate member forming the C-shaped elements. The two tubes 14, 15 are offset from a central longitudinal axis and extend in opposite directions such that, when the elongate member of each C-shaped element is connected into a respective tube 14, 15, the two C-shaped elements are approximately parallel with one another. The width W of the core section 13 is the distance between the outside longitudinal side of one tube 14 and the outside longitudinal side of the other tube 15. The two fixed frame elements 2, 3 are respectively secured to the two tubes 14, 15 by a metal tack.

Two additional supporting members 16, 17 made from a hollow plastic tube, which are open at one end and closed at the opposite end, are pivotally mounted at their closed end on the central core section 13. One pivotally mounted tube 16 is mounted such that it shares the same approximate longitudinal axis as a tube 14 of the core section 13 when in the collapsed state as shown in FIG. 10. Correspondingly, the other pivotally mounted tube 17 is mounted such that it shares the same approximate longitudinal axis as hollow section 14 of the core section 13 when in the collapsed state. Therefore, each pivotally mounted tube 16, 17 has a first position in which it is substantially parallel to a tube 14, 15 of core section 13. Each pivotally mounted tube 16, 17 can be independently rotated to a second extreme position which is approximately perpendicular to the longitudinal axis of the tubes 16, 17 of the core section and which shares the same approximate plane. This 'deployed' state is shown in FIG. 12 which shows each tube 14, 15, 16 and 17 and therefore each connected C-shaped element at substantially right angles to one another.

The two releasable frame elements 4, 5 are releasably connected to the two pivotally mounted tubes 16, 17 via a ball and socket pop catch. The catch comprises a hole (socket) in the side of each tube 16, 17 and a correspondingly sized ball which extends out from the side of each frame element and which can be depressed into the frame element. The frame elements 4, 5 are therefore connected by inserting the ends of the frame elements 4, 5 into the tubes 16, 17 and lining up the ball and the hole so that the ball extends out from the frame element and into the hole, thus holding the frame in place.

Figure 4:
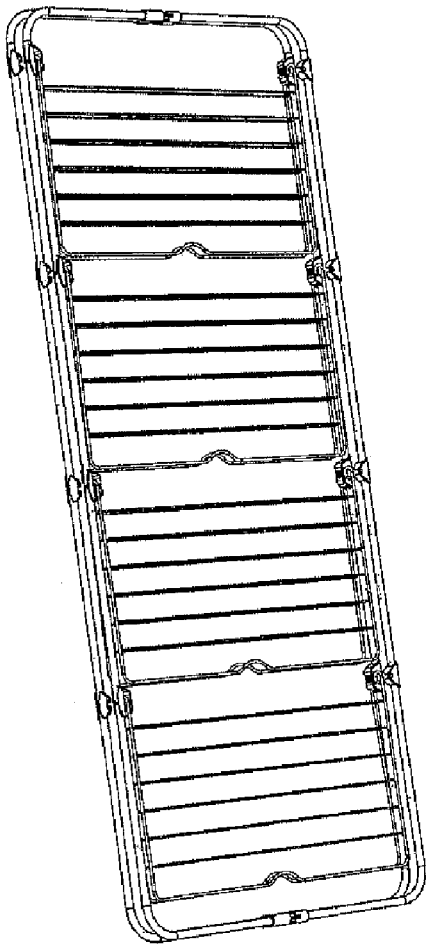
FIG. 4 is a perspective view of the clothes airer shown in FIG. 1 when in collapsed but not dismantled state.

Connecting the individual C-shaped elements 2, 3, 4, 5 to a connecting member 6, 7 at either end permits the assembly of a basic clothes airer frame to which the shelves 10 can be attached. The pivoting function of the connecting members 6, 7 gives rise to a clothes airer that can be moved from a deployed position shown in FIG. 1 to a collapsed position shown in FIG. 4.

Figure 7:
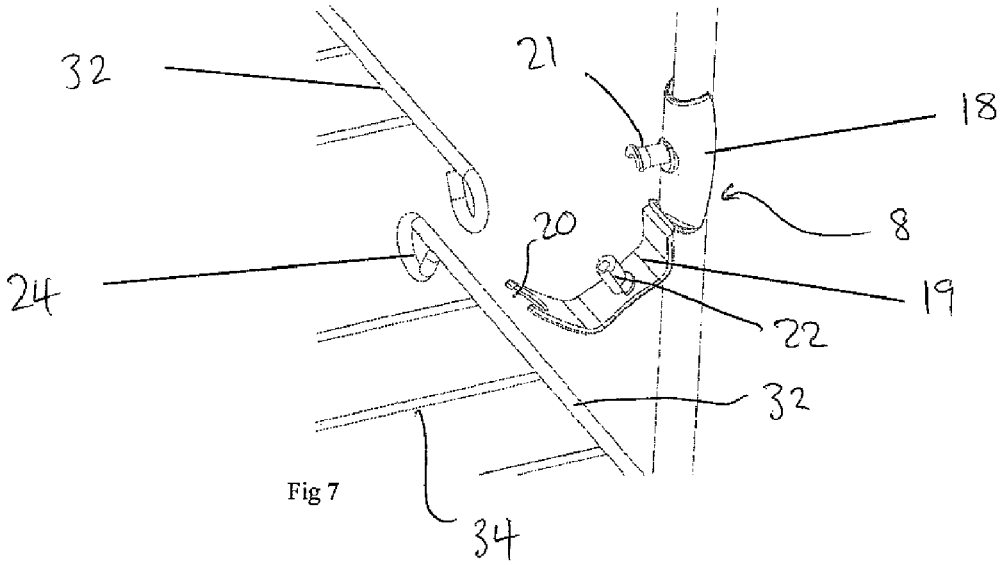
FIG. 7 is a perspective view of a support which is fixed to the frame and in an open position ready to receive two shelves of the clothes airer shown in FIG. 1.

Each rectangular shelf 10 is comprised of a cylindrical elongate member, again typically made from mild steel, bent at right angles at two points along its length and along the same plane to form side arms 32, 33 and create a U-shape frame. A plurality of thin straight elongate members 34 made from mild steel extend across the length of the U-shaped frame at regularly spaced apart intervals and are welded at opposite ends to the side arms 32, 33. Referring to FIG. 7, at either terminating end of the U-shaped frame, a substantially complete loop 24 is formed to provide a means for mounting the shelf 10 to a pair of supports 8. The length of each shelf 10 is approximately equal to the distance between an opposed pair of supports 8 when the airer is in the deployed position. The width of each shelf 10 is approximately equal to half the distance between an opposed pair of retention clips 9 when in the deployed position. The interval between each support 8 on a fixed C-shaped frame 2, 3 is therefore chosen to be slightly greater than the width of a U-shaped shelf 10 so that the shelves do not overlap when in a collapsed state.

Figure 8:
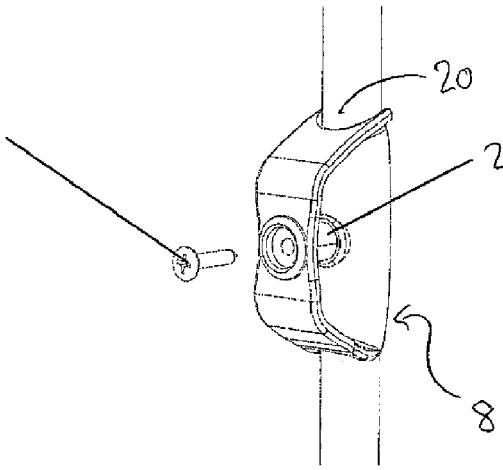
FIG. 8 is a perspective view of the support shown in FIG. 7 in a closed state ready to receive a securing screw.
Figure 9:
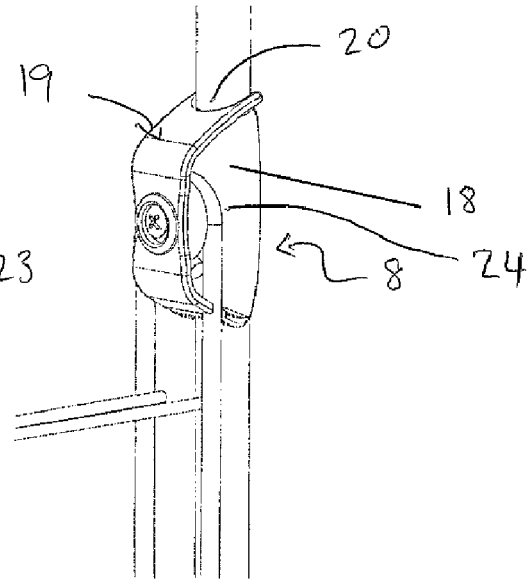
FIG. 9 is a perspective view of the support shown in FIG. 7 in a closed state and secured with a screw and having two shelves securely mounted thereto.

Referring to FIGS. 7, 8 and 9, the moulded plastic supports 8 are comprised of a mounting part 18 and a cover part 19. Mounting part 18 is semi-cylindrical in shape and is dimensioned to fit snugly around the upright length of a C-shaped element. Cover part 19 has three sides forming a U-shape and is hingably attached at one end to a corresponding end of the mounting part 18. A semi-circular portion 20, whose diameter is approximately equal to that of the mounting part 18, is cut out of the opposite end of the cover part 19. The cover part 19 has an open position shown in FIG. 7 whereby it extends away from the mounting part 18 and a closed position shown in FIGS. 8 and 9 whereby the cover part 19 is mounted against the mounting part 18 and the semi-circular portion 20 is seated around the upright length of the C-shaped element. In the closed position, cover part 19 defines a gap between itself and the mounting part 18.

A complimentary 'half-strut' 21, 22 is integrally formed on either part 18, 19 of the support 8 such that they extend toward one another. The half-struts 21, 22 are arranged such that, in the closed position, they form a single strut 23 to which the looped end 24 of a shelf 10 can be mounted. One of the half-struts 21 has a central hollow core for receiving a screw via a corresponding hole in a side of the cover part 19. Referring to FIG. 8, the screw may be threaded through the completed strut in the closed position and into a screw hole (not shown) in the wall of the C-shaped element via a complimentary hole (not shown) in the mounting part 18.

Respective loop ends 24 of two shelves 10 are mounted to the half-strut 22 of the mounting part 18 when the support 8 is in the open position shown in FIG. 7. The cover part 19 is then closed and secured to the mounting part 18 to complete the strut 23 and retain the shelves 10 in place as shown in FIG. 9. The loops 24 are closed to the extent that they cannot be removed from the strut without first opening the support 8. In this mounted position, the strut 23 gives rise to a point about which the shelves 10 can pivot and be inserted into the retention clips 9 in the deployed position.

The moulded plastic retention clip 9 comprises a mounting portion 25 which is a partially complete cylinder and dimensioned to fit securely around the upright of a C-shaped element. The retention clip 9 further comprises a curved retention portion 26 which extends out from the mounting portion 25. A recess 28 is cut out from the part of the retention portion 26 that is furthest from the mounting portion 25 such that the recess is perpendicular to the upright length of the C-shaped element when the retention clip 9 is mounted thereon. The recess 28 has an entrance point 29 and an inner portion 30 which is dimensioned to securely seat an elongate side 27 of a shelf 10. The distance across the recess entrance 29 is less than the diameter of the elongate member from which the shelf 10 is formed and its walls are sufficiently resilient to require a degree of force to be used in order to insert (or remove) the elongate side 27 of the shelf 10 in to (or out of) the recess 28. The side walls 30 of the retention portion 26 are angled from the retention portion 26 to the recess entrance 29 so that they guide the elongate side 27 of a shelf 10, which typically extends beyond the entrance point 29 when mounted and in a horizontal plane, into the recess 28 from beneath the retention clip 9.

When mounted at either end to a pair of oppositely facing supports 8 and when the clothes airer 1 is in the deployed position, the shelf 10 can be rotated about the struts 23 of the supports 8 and secured into a corresponding retention clip 9 as shown in FIG. 1. The shelf 10 has a curved portion 31 at the midpoint of its longest length 27 which extends inwardly and permits the shelf 10 to be inserted into the recess 28 of the retention clip 9. When the shelf 10 is deployed in this way, it extends generally horizontally.

The pair of supports 8 to which a shelf is pivotally mounted work in conjunction with a correspondingly positioned retention clip 9 on the adjacent frame element to provide a reliable and secure mounting procedure for a shelf in the horizontal plane. When the shelf 10 is rotated into position within the retention clip 9, the loop 24 at the two adjacent corners of the shelf prevent the shelf from being forced off the supports 8 and permits a degree of force to be exerted on the retention clip 9 by the elongate side 27 of the shelf in order to seat it within the recess 28. When the shelf 10 is removed from the retention clip 9, it can rotate downwardly about the supports 8 until it hangs from the supports 8 in a downward direction.

Figure 5:
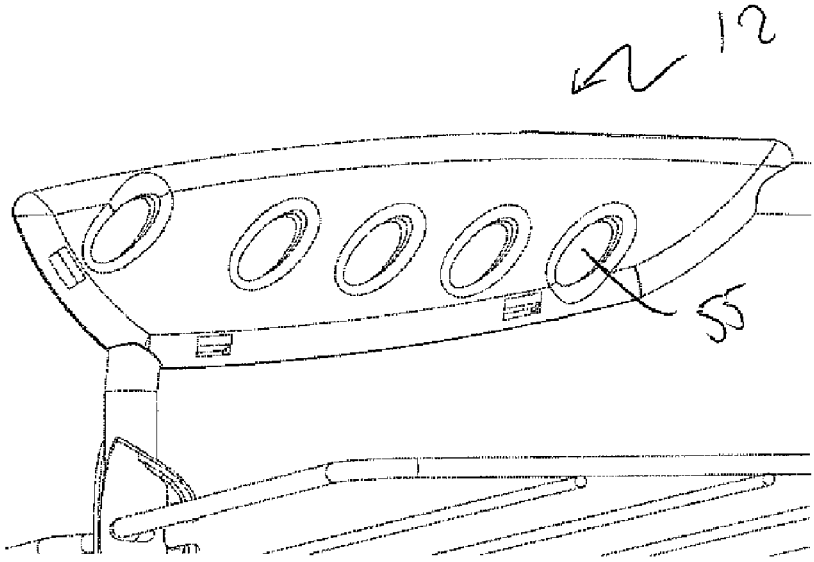
FIG. 5 is a perspective view of a hanger support fixed to the frame of the clothes airer shown in FIG. 1.
Figure 6:
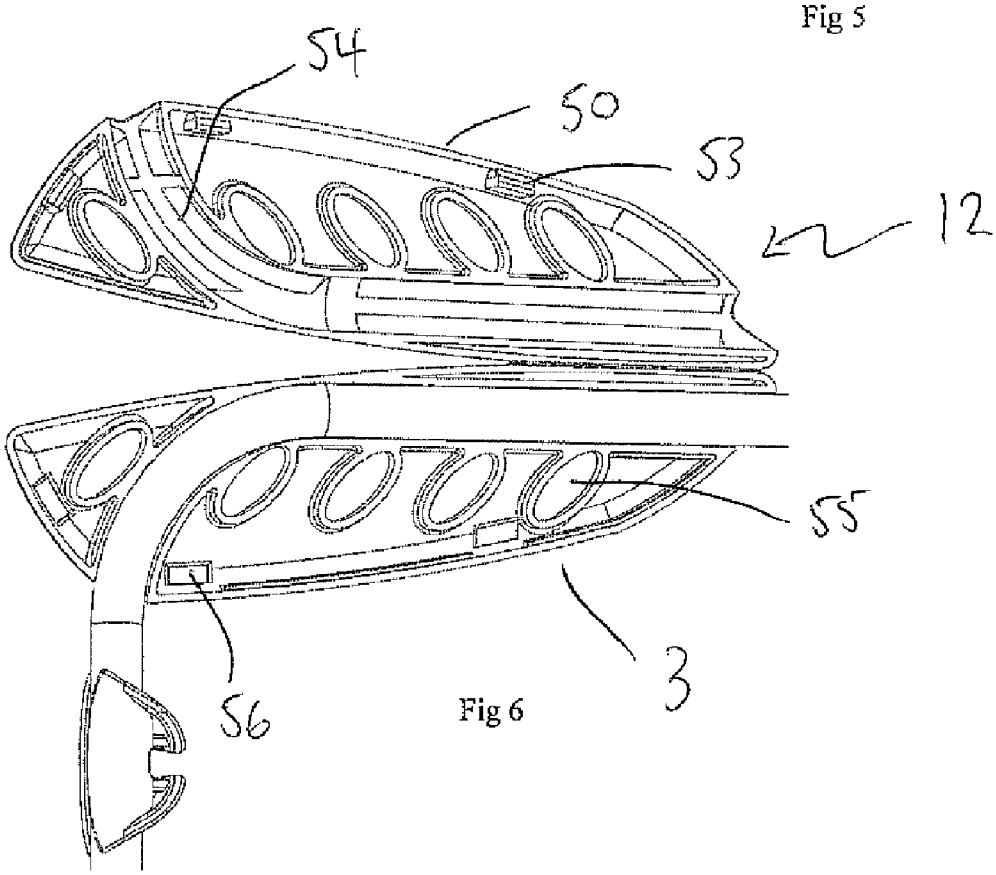
FIG. 6 is a perspective view of the hanger support shown in FIG. 5 in an open state.

Referring to FIGS. 5 and 6, the hanger support 12 comprises two moulded plastic half sections 50, 52 generally rectangular in shape which mirror one another and are hinged together along the edge of a corresponding length. An outline 54 of the top corner of a C-shaped frame element is indented into the body of each half section 50, 52 so that the C-shaped frame element can be comfortably seated within the body of the hanger support 12. Three small clips 53 extend out from the edge of a half section 50 opposite the hinge side of the hanger support. Three corresponding cut-outs 56 are formed at the same locations on the opposite half section 52 of the hanger support 12. The cut-outs 56 are sized and shaped to receive the clips 53 so that the two half sections 50, 52 can be secured together. Five circular cut-outs 55 are formed through the main body of the hanger support 12 and provide a support to which can be mounted a plurality of coat hangers. To secure the hanger support 12 to the top corner of a C-shaped frame element, the hanger support 12 is hinged open, a half section 52 is placed around the frame so that the frame is seated in the indent 54 and the other half section 50 is closed and locked into position via the small clips 53.

Figure 14:
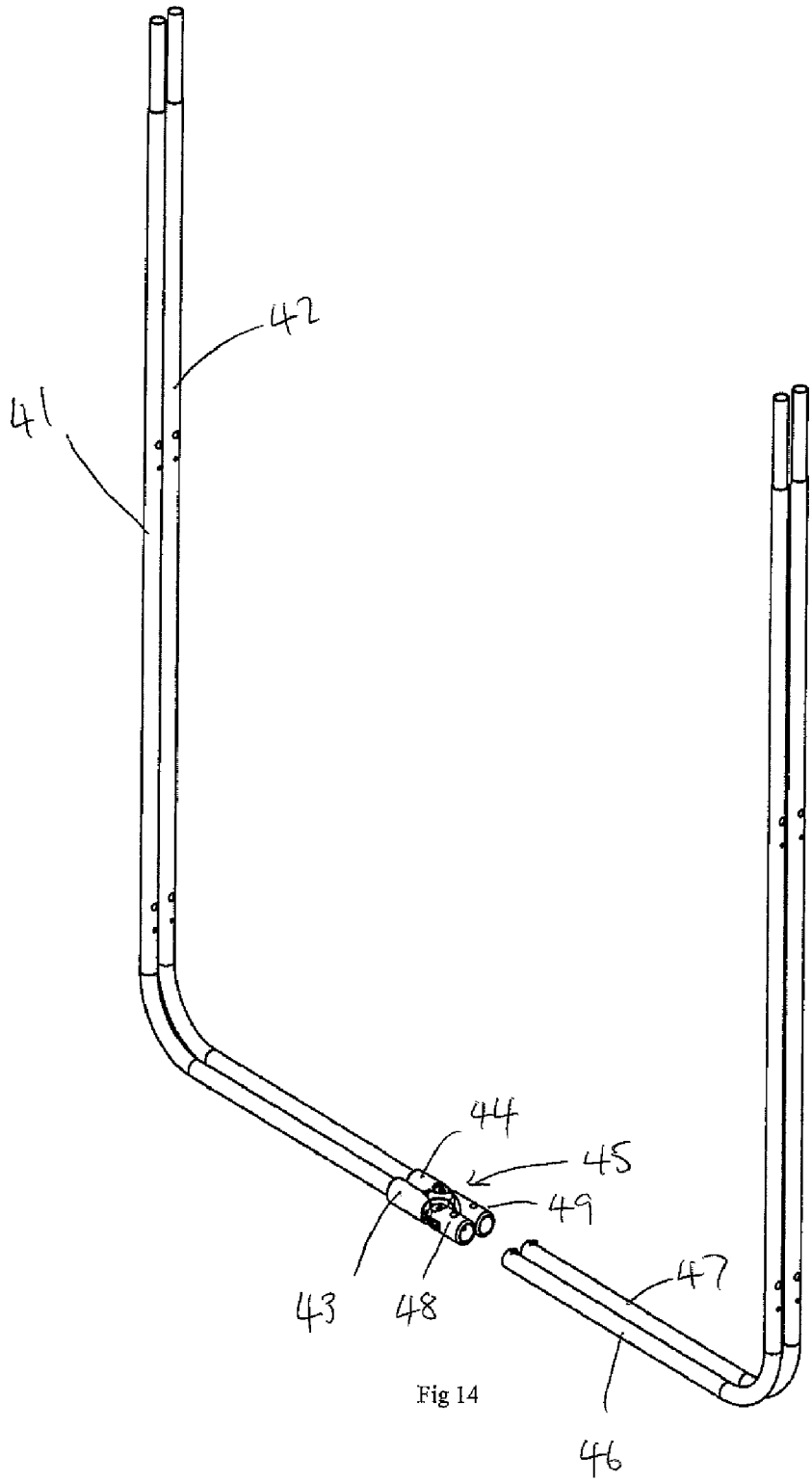
FIG. 14 is a perspective view of the lower half framework of a clothes airer and its relationship with a connecting member according to the present invention.
Figure 15:
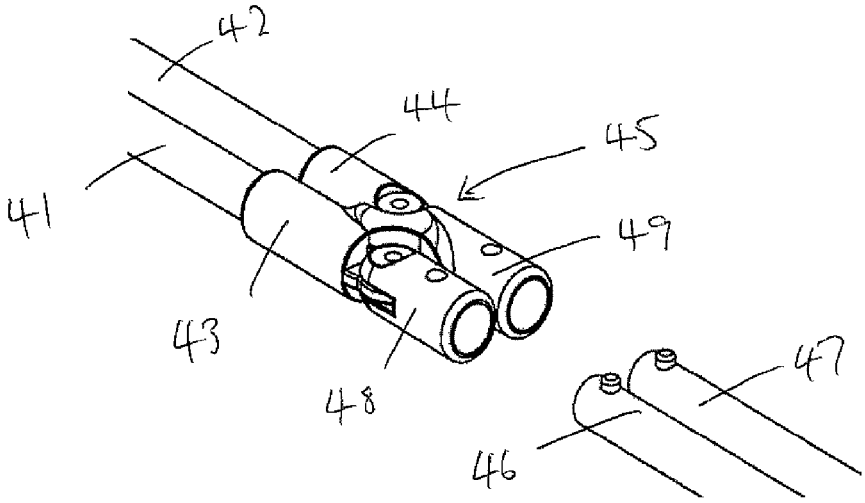
FIG. 15 is an enlarged perspective view of the connecting member shown in FIG. 14.
Figure 16:
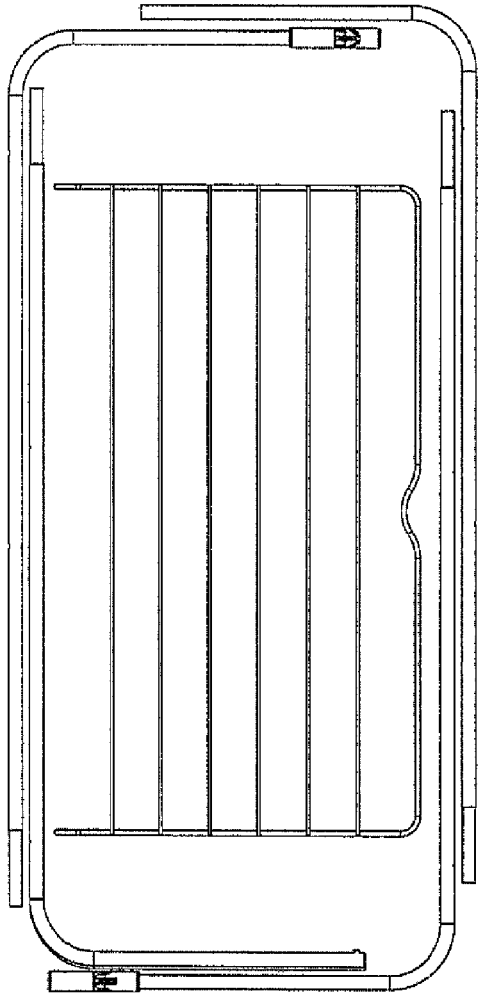
FIG. 16 is a plan view of the clothes airer shown in FIG. 1 in a dismantled state.

In an alternative embodiment, referring to FIGS. 14 and 15, the lower half of two C-shaped frame elements 41, 42 are fixed to the supporting members 43, 44 of one end of the connecting member 45 and the other two frames 46, 47 are releasably connected to the supporting members 48, 49 of the opposite end of the connecting member 45. This arrangement is mirrored at the opposite end of the frame elements 41, 42, 46, 47. The two releasable frames 46, 47 are releasably connected by a ball and socket pop catch as hereinbefore described and depicted in detail on FIG. 15. Releasably connecting two frame elements to one end of the connecting member permits the tower airer 1 to be broken down into its constituent parts. In other words, the releasable C-shaped frame elements can be broken down into their respective L-shaped parts which, in turn, can be removed from the connecting member 45. Likewise, the fixed C-shaped frame elements 46, 47 can be broken down into their respective L-shaped parts leaving a connecting member 45 attached to the end of each part. Thus, a tower airer connected in this manner can be packed into an even tighter space than the first embodiment as shown in FIG. 16 which improves its transportability.

The above embodiments are described by way of example only; many variations are possible without departing from the invention as defined by the appended claims.

The invention claimed is:

1. A connecting member for connecting a plurality of frame elements, the connecting member comprising a core section having a width and two fixed supporting members for supporting frame elements extending in different directions from the connecting member and lying within a plane, the connecting member having at least two moveable supporting members, each for supporting a further frame element, each moveable supporting member being pivotally connected to the core section and independently moveable relative to the core section between a first position in which each moveable supporting member lies within the width of the core section and a second position in which a frame element supported by each moveable supporting member will extend in a direction generally perpendicular to a frame element supported by a fixed supporting member of the core section, said moveable supporting members lying within substantially the same plane as the fixed supporting members and being moveable within the plane.

2. A connecting member according to claim 1, wherein one moveable supporting member is pivotally mounted to one side of the core section and the other moveable supporting member is pivotally mounted to the opposite side of the core section.

3. A connecting member according to claim 1, wherein the moveable supporting members are arranged to support frame elements in substantially parallel spaced apart directions.

4. A connecting member according to claim 1, wherein the fixed supporting members of the core section are arranged to support frame elements in substantially parallel, spaced apart directions.

5. A connecting member according to claim 1, wherein the supporting members comprise fittings arranged to connect to a frame element.

6. A connecting member according to claim 1, wherein the supporting members comprise hollow tubes.

7. A connecting member according to claim 1, wherein the supporting members are arranged to support elongate frame elements.

8. A connecting member according to claim 7, wherein the hollow tubes have an internal diameter which is substantially equivalent to the external diameter of an elongate frame element that is intended to be supported by the connecting member.

9. A connecting member as claimed in claim 1, wherein the width of the core section is the distance between the outside longitudinal side of one fixed supporting member and the outside longitudinal side of the other fixed supporting member.

10. A connecting member as claimed in claim 1, wherein the core section, which includes the two fixed supporting members, comprises a single moulded piece to which is pivotally attached the two moveable supporting members.

11. A clothes airer comprising a connecting member wherein said connecting member comprises a core section having a width and two fixed supporting members from which extends respective frame elements each extending in different directions from the connecting member, said fixed supporting members lying within a plane, the connecting member having two moveable supporting members, each supporting a further frame element, each moveable supporting member being pivotally connected to the core section and independently moveable relative to the core section between a first position in which each moveable supporting member lies within the width of the core section and a second position in which a frame element supported by the moveable supporting member extends in a direction generally perpendicular to each frame element supported by the fixed supporting members of the core section, said moveable supporting members lying within substantially the same plane as the fixed supporting members and being moveable within the plane.

12. A clothes airer according to claim 11, comprising two connecting members and four frame elements connecting the two connecting members together.

13. A clothes airer according to claim 12, wherein two frame elements are fixed to respective supporting members of each connecting member and the two other frame elements are releasably attached to respective supporting members of each connecting member.

14. A clothes airer according to claim 12, wherein two frame elements each comprise a shelf support attached thereto at substantially the same corresponding point on the respective frame element, said frame elements extending from the fixed supporting members the other two frame elements each comprising a shelf retention clip attached thereto at substantially the same point along their respective lengths as the shelf supports on the frame elements extending from the fixed supporting members, said frame elements to which the shelf retention clips are attached extending from the moveable supporting members.

15. A clothes airer according to claim 14, comprising at least one shelf.

16. A clothes airer according to claim 14, wherein each retention clip has a recess that is sized and configured to receive a longitudinal edge of a shelf.

* * * * *